US005345911A

United States Patent [19]

Kadowaki et al.

[11] Patent Number: 5,345,911

[45] Date of Patent: Sep. 13, 1994

[54] AIR FUEL RATIO CONTROL APPARATUS FOR INTERNAL COMBUSTION ENGINE

[75] Inventors: Hisashi Kadowaki; Takashi Arimura, both of Kariya, Japan

[73] Assignee: Nippondenso Co., Ltd., Kariya, Japan

[21] Appl. No.: 131,626

[22] Filed: Oct. 5, 1993

[30] Foreign Application Priority Data

Oct. 6, 1992 [JP] Japan ..... 4-267531

[51] Int. Cl.[5] ..... F02D 41/04

[52] U.S. Cl. ..... 123/436

[58] Field of Search ..... 123/419, 436, 479; 364/431.08

[56] References Cited

U.S. PATENT DOCUMENTS

| | | | |
|---|---|---|---|
| 4,513,721 | 4/1985 | Ina et al. | 123/436 X |
| 4,543,934 | 10/1985 | Morita et al. | 123/436 X |
| 4,582,038 | 4/1986 | Canta et al. | 123/436 X |
| 4,736,724 | 4/1988 | Hamburg et al. | 123/436 X |
| 4,930,479 | 6/1990 | Osawa et al. | 123/436 |
| 5,018,498 | 5/1991 | Hoover | 123/436 X |
| 5,213,081 | 5/1993 | Fujimoto | 123/436 |
| 5,224,452 | 7/1993 | Tomizawa | 123/436 |
| 5,239,473 | 8/1993 | Ribbens et al. | 123/436 X |
| 5,251,601 | 10/1993 | Leshner | 123/436 |
| 5,287,282 | 2/1994 | Imai | 123/436 X |

FOREIGN PATENT DOCUMENTS 60-122234 6/1985 Japan .

*Primary Examiner*—Willis R. Wolfe

*Attorney, Agent, or Firm*—Cushman, Darby & Cushman

[57] ABSTRACT

An apparatus capable of performing correct determination of a misfire limit without involving influence by differences between individual internal combustion engines, and thus capable of realizing highly precise lean control. During lean control, a mean deviation $MD_{\lambda=1}$ of angular-velocity differences, which has been learned during the adoption of the stoichiometric air-fuel ratio (i.e., during $\lambda=1$) in the relevant internal combustion engine, is subtracted from the current mean deviation $MD_L$ of angular-velocity differences occurring in the engine, so that the fuel injection amount is corrected in accordance with the resultant difference $\Delta MD$, which is attributable to an increase in the risk of misfire. Thus, the mean deviation component $MD_{\lambda=1}$ which corresponds to the stoichiometric air-fuel ratio and which may differ between individual internal combustion engines, is eliminated, and only the component $\Delta MD$ attributable to an increase in the risk of misfire is used to control the air-fuel ratio, thereby eliminating influence of differences between internal combustion engines to enable correct determination of a misfire limit.

4 Claims, 3 Drawing Sheets

AIR FUEL RATIO CONTROL APPARATUS FOR INTERNAL COMBUSTION ENGINE

BACKGROUND OF THE INVENTION

The present invention relates to an air-fuel ratio control apparatus for an internal combustion engine and, particularly, to such an air-fuel ratio control apparatus capable of controlling the air-fuel ratio to a value for producing a leaner air-fuel mixture than a mixture at the stoichiometric air-fuel ratio when the engine is in a predetermined operating region so that the engine can operate with the thus controlled air-fuel ratio.

A type of air-fuel ratio control apparatuses in which control, known as "lean control", is employed, has been used in recent years. In lean control, the air-fuel ratio of the internal combustion engine is controlled to a value for producing a leaner air-fuel mixture than a mixture at the stoichiometric air-fuel ratio, that is, controlled to a value on the lean side of the stoichiometric value, with a view to reducing the level of fuel consumption and emission. In order to achieve the maximum possible effect for the reduction of fuel consumption and emission, such air-fuel ratio control is required to be able to control the air-fuel ratio to a value immediately behind a misfire limit of the air-fuel ratio. To meet the requirement, various methods for determining the misfire limit have been carried out. An example of such methods is Japanese Patent Unexamined Publication No. 60-122234, which discloses an air-fuel ratio control apparatus.

The air-fuel ratio control apparatus has an arrangement based on the fact that, when the condition of combustion in an internal combustion engine shifts from a normal region toward a limit beyond which the combustion condition enters into a misfire region, variations of the rotation of the engine increase. In the arrangement, a misfire limit is determined on the basis of such increased variations of engine rotation. Specifically, the speed of rotation of the engine is detected by a crank-angle sensor, and variations of engine rotation at a predetermined crank angle are sequentially calculated on the basis of the detected rotational speed. Standard deviations are calculated from the variations of engine rotation, and are each compared with a threshold value previously set in correspondence with a misfire limit. When the standard deviation is less than the threshold value, the combustion condition is determined to be still within a normal region, and an amount for correcting the air-fuel ratio is amended for correction to a value on the lean side. When the standard deviation is above the threshold value, it is determined that the misfire limit has been reached, and the air-fuel ratio correction amount is amended for correction to the rich side. The air-fuel ratio of the internal combustion engine is controlled in this way around a misfire limit. Since the air-fuel ratio corresponding to the misfire limit varies between various operating regions of the internal combustion engine, such as those concerning the number of revolutions per unit time of the engine and the amount of intake air, the disclosed air-fuel ratio control apparatus is arranged to set a threshold value for each of a plurality of operating regions.

Thus, the above air-fuel ratio control apparatus is arranged to set a threshold value for each operating region, and to effect air-fuel ratio control in accordance with a misfire limit appropriate to the current operating region. With this apparatus, however, no consideration is given to differences in the degree of variation of engine rotation between individual internal combustion engines. As a result, a misfire limit may not always be determined correctly.

That is, in an internal combustion engine, variations of engine rotation may be generated even within a normal combustion region employing, for instance, the stoichiometric air-fuel ratio. Such engine-rotation variations are caused by factors such as variations in the condition of combustion in the engine per se, detection errors of the crank-angle sensor, or errors of a CPU clock, and the variations assume values differing between individual internal combustion engines. With the above air-fuel ratio control apparatus, a standard deviation, which is calculated as the sum of an engine-rotation variation component caused by factors, such as above, and a component related to an increased risk of misfire, inevitably includes a fraction influenced by differences between individual internal combustion engines. Since a shift from a normal combustion region to a misfire limit causes a much smaller increase in engine-rotation variation than a complete shift from the same region into a misfire region, the influence of differences between individual internal combustion engines makes it impossible for a misfire limit to be correctly determined. As a result, the air-fuel ratio may be erroneously controlled, sometimes to a value on the lean side, resulting in misfire, and hence, impaired drivability, and in other cases, to a value on the rich side, making it impossible to achieve sufficient reduction of fuel consumption and emission.

SUMMARY OF THE INVENTION

An object of the present invention is to provide an air-fuel ratio control apparatus capable of correctly determining a misfire limit without involving influences by differences between individual internal combustion engines, and thus capable of performing highly precise lean control.

As shown in FIG. 1, an air-fuel ratio control apparatus for an internal combustion engine according to the present invention controls the air-fuel ratio for an internal combustion engine M1 in accordance with the operating region of the internal combustion engine M1 within a range of the air-fuel ratio from a value having substantially no risk of misfire to a value on the lean side of the stoichiometric air-fuel ratio and close to a misfire limit, the apparatus comprising: variation detecting means M2 for detecting variations periodically generated in synchronization with the rotation of the internal combustion engine M1; variation learning means M3 for learning the latest one of variations detected by the variation detecting means M2 when the air-fuel ratio for the internal combustion engine M1 is controlled at a value having substantially no risk of misfire; and lean air-fuel ratio correcting means M4 for correcting the air-fuel ratio for the internal combustion engine M1 on the basis of the current variation detected by the variation detecting means M2 and the variation which has been learned by the variation learning means M3 when the air-fuel ratio for the internal combustion engine M1 is controlled at a value close to the misfire limit.

According to the present invention, when the air-fuel ratio for the internal combustion engine H1 is controlled at a value having substantially no risk of misfire, for example, at the stoichiometric air-fuel ratio, or a value for a fuel-cut operation, the variation learning means H3 learns each variation of rotation of the internal combustion engine M1 detected by the variation detecting means M2. Since each variation generated at this time is a variation caused by factors inherent to the internal combustion engine M1 and irrelevant to misfire, the variation assumes a value corresponding to the differences of the engine M1 itself from other internal combustion engines.

When the air-fuel ratio for the internal combustion engine M1 is controlled at a value close to a misfire limit, that is, during lean control, the lean air-fuel ratio correcting means M4 corrects the air-fuel ratio for the internal combustion engine M1 on the basis of the current variation detected by the variation detecting means M2 and the variation which has been learned by the variation learning means M3. The current variation occurring during the lean control is the sum of a variation component which can be caused when the air-fuel ratio is at a non-misfire-risk value and a variation component caused by an increase in the misfire risk. Therefore, if, for example, the variation which has been learned by the variation learning means M3 is subtracted from the current variation during the lean control, it is possible to obtain the variation that is solely attributable to an increase in the risk of misfire, so that the air-fuel ratio can be corrected on the basis of the thus obtained variation. Thus, it is possible to determine a misfire limit while eliminating the influences by differences of the internal combustion engine M1 itself.

BRIEF DESCRIPTION OF THE DRAWINGS

The present invention will be described with reference to the accompanying drawings, in which.

DESCRIPTION OF THE PREFERRED EMBODIMENTS

Figure 2:
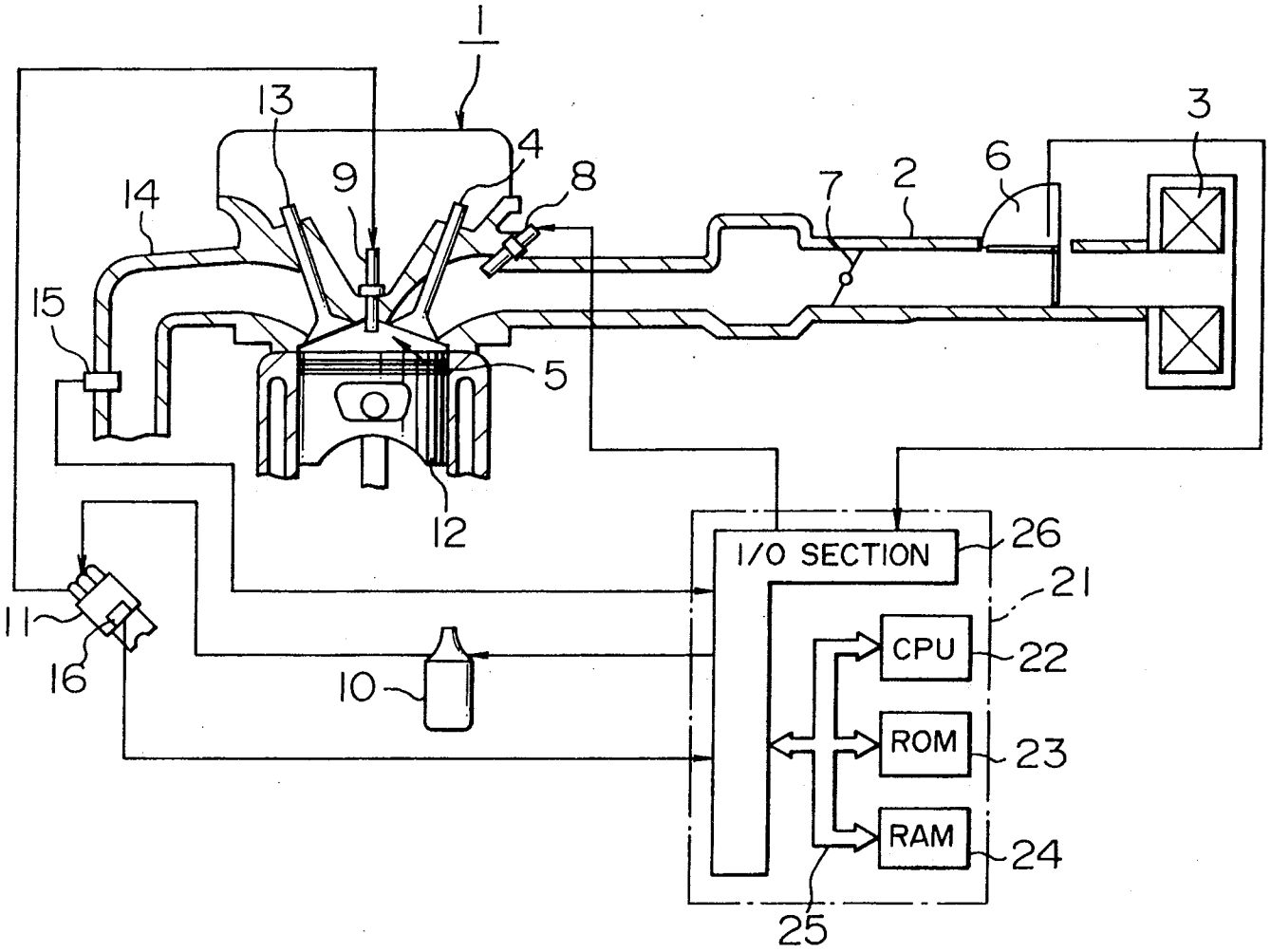
FIG. 2 is a diagram schematically showing an air-fuel ratio control apparatus for an internal combustion engine according to an embodiment of the present invention.

Referring to FIG. 2, an internal combustion engine 1 combined with an air-fuel ratio control apparatus according to an embodiment of the present invention is a four-cycle four-cylinder spark-ignition engine which may be used in a vehicle. The internal combustion engine has an intake passage 2 with an air cleaner 3 disposed at an upstream position thereof. Intake air passed through the air cleaner 3 is supplied through the intake passage 2 and an intake valve 4 into a combustion chamber 5 within each cylinder. An air flow meter 6 is disposed at a position of the intake passage 2 which is downstream of the air cleaner 3 so as to detect the amount of intake air. A throttle valve 7 is disposed at another position of the intake passage 2 which is downstream of the air flow meter 6 so as to adjust the amount of intake air in accordance with the operation of the accelerator, not shown, by the operator. A fuel injection valve 8 is disposed, in correspondence with each cylinder, at a most downstream position of the intake passage 2 so that, fuel injected by the fuel injection valve 8 in synchronization with the rotation of the crankshaft, not shown, can be mixed with intake air passing through the intake passage 2 so as to form an air-fuel mixture, which is supplied into the corresponding combustion chamber 5.

An ignition plug 9 is provided for the combustion chamber 5 of each cylinder. A distributor I1 distributes ignition current from an ignition coil 10 to each of the ignition plugs 9 in synchronization with the rotation of the crankshaft. An air-fuel mixture supplied to each combustion chamber 5 is ignited by the corresponding ignition plug 9, undergoes combustion while pushing down a corresponding piston 12 to impart torque to the crankshaft, and is exhausted thereafter to the outside of the system through an exhaust valve 13 and an exhaust passage 14. An A/F sensor 15 is disposed in the exhaust passage 14 for outputting a linear air-fuel ratio signal indicating the air-fuel ratio of exhaust gas. A crank-angle sensor 16 is provided on the distributor 11 for outputting a pulse signal in synchronization with the rotation of the crankshaft each time the crankshaft rotates by 30°.

An electronic controller 21 for the internal combustion engine 1 has an arithmetic logic circuit which mainly comprises a central processing unit (CPU) 22, a read-only memory (ROM) 23 and a random-access memory (RAM) 24, and which is connected with an input-output (I/O) section 26 through a common bus 25. The input-output section 26 is connected with each of the air flow meter 6, the fuel injection valves 8, the ignition coil 10, the A/F sensor 15 and the crank-angle sensor 16, so that the CPU 22 is able to input and output various signals from and to these devices through the input-output section 26. The ROM 23 stores various programs for controlling the operating condition of the internal combustion engine 1, such as a fuel injection amount control program for the fuel injection valves 8 and an ignition timing control program for the ignition plugs 9, so that the CPU 22 can perform processings in accordance with the stored programs. The RAM 24 temporarily stores data on processings performed by the CPU 22. 1 The CPU 22 selectively performs normal air-fuel ratio control and lean control in accordance with the operating condition of the internal combustion engine 1. As is known, during normal air-fuel ratio control, the injection amount of the fuel injection valves 8 is set to a value in accordance with the operating condition of the internal combustion engine 1, and the fuel injection amount is feedback controlled on the basis of the air-fuel ratio of exhaust gas detected by the A/F sensor 15 in such a manner as to achieve the target air-fuel ratio, that is, the stoichiometric air-fuel ratio $\lambda=1$. During lean control, the fuel injection amount of the fuel injection valves 8 is corrected to a value for achieving an air-fuel ratio on the lean side (lean air-fuel ratio) by multiplying the fuel injection amount by an air-fuel ratio correction coefficient f ($f<1.0$) among various air-fuel ratio correction coefficients f mapped in correspondence with each of various operating regions of the internal combustion engine 1, and the fuel injection amount is feedback controlled on the basis of rotational variations of the internal combustion engine 1 in such a manner as to maintain the actual air-fuel ratio on the lean side of the stoichiometric air-fuel ratio ($\lambda=1$) in the vicinity of a misfire limit.

Feedback control performed during lean control in accordance with rotational variations of the internal combustion engine 1 will be outlined.

Figure 1:
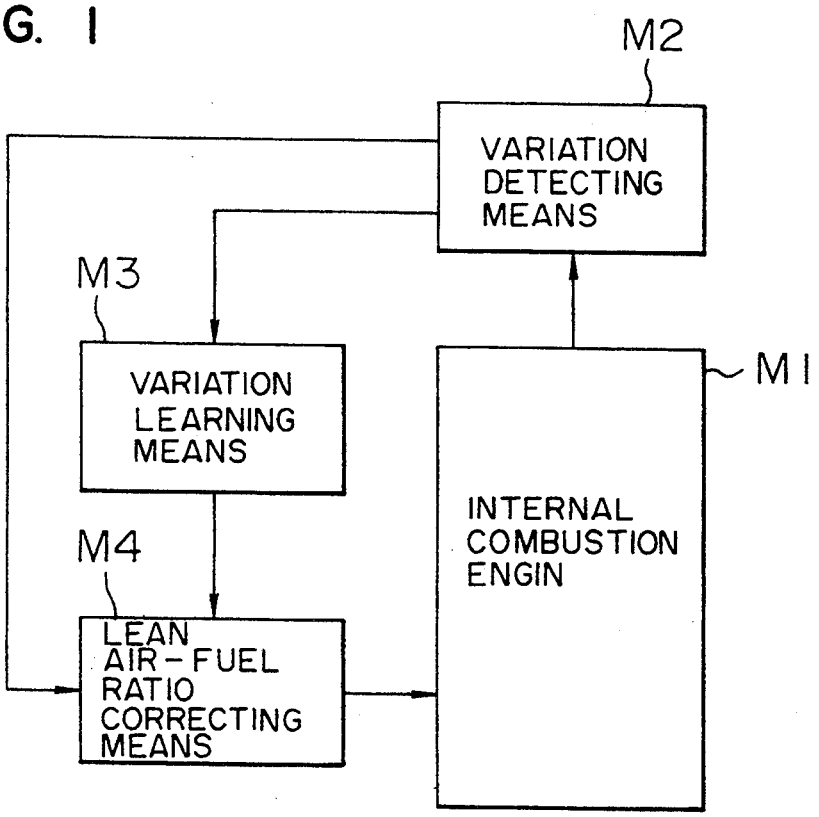
FIG. 1 is a block diagram schematically showing an embodiment of the present invention, the components of the embodiment being shown in correspondence with constituents appearing in the attached claims.
Figure 3:
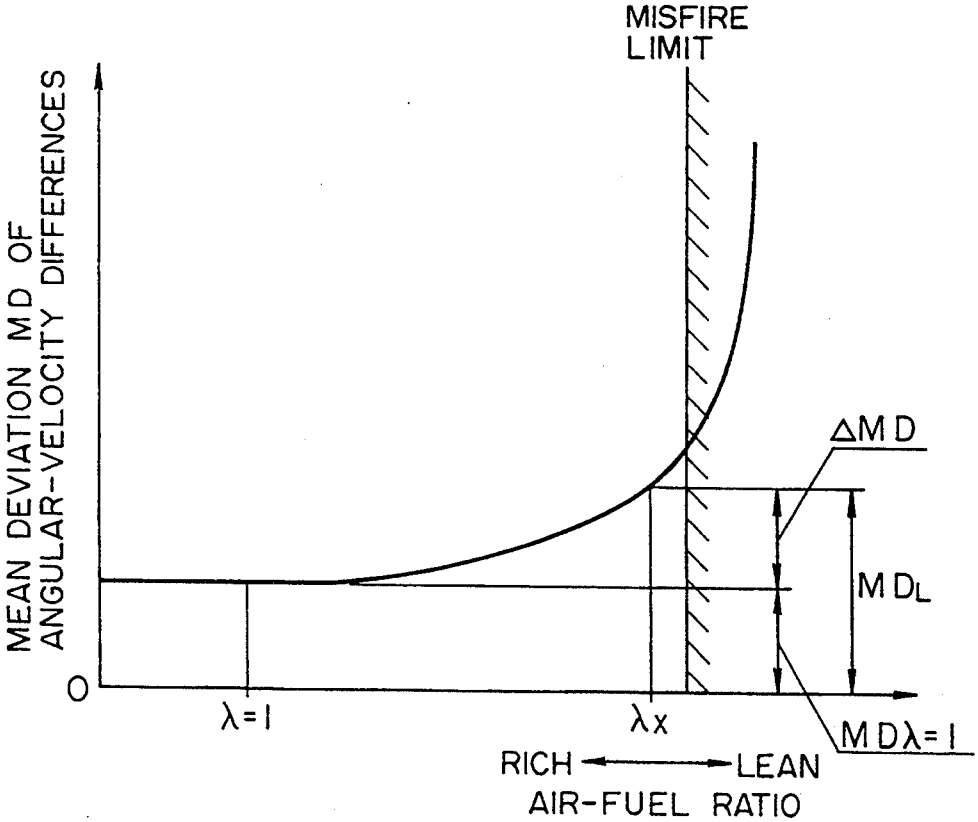
FIG. 3 is a graph for illustrating the relationship between the air-fuel ratio X and the mean deviation MD of angular-velocity differences assumed in the air-fuel ratio control apparatus according to the present invention.

FIG. 3 is a graph showing the relationship between the air-fuel ratio and the mean deviation of differences between angular velocities assumed in the air-fuel ratio control apparatus.

In the air-fuel ratio control apparatus according to this embodiment, a misfire limit in the associated internal combustion engine 1 is determined on the basis of the mean deviation of differences between angular velocities of the engine rotational speed Ne (the angular-velocity differences indicating variations of the rotation of the engine 1). That is, when the rotation of the internal combustion engine 1 is stable, the angular velocity that is assumed at a predetermined crank angle (e.g., a crank angle (CA) of 30°) past a point corresponding to ignition in each cylinder assumes substantially the constant value, and the difference between such angular velocities with regard to cylinders in which ignition has sequentially occurred is close to zero. However, when the rotation of the internal combustion engine 1 is unstable, angular velocities vary, producing a difference of a certain magnitude between the current angular velocity and the immediately previous one. Therefore, a mean deviation of differences between angular velocities indicates a degree of variation in the rotation of the internal combustion engine 1.

As shown in FIG. 3, when the air-fuel ratio $\lambda$ is within a first region in which the ratio $\lambda$ is 1 or in the vicinity thereof, the mean deviation MD of angular-velocity differences assumes a relatively small value. As the air-fuel ratio $\lambda$ shifts toward the lean side, the mean deviation MD of angular-velocity differences gradually increases, and, when the ratio $\lambda$ has shifted beyond a misfire limit, the mean deviation MD of angular-velocity differences increases sharply. In the first region at or in the vicinity of the stoichiometric air-fuel ratio $\lambda=1$, since no rotational variations are caused by the risk of misfire, it is possible to regard mean deviations MD of angular-velocity differences occurring at such time as those caused by factors inherent to the internal combustion engine 1 and irrelevant to the risk of misfire. The factors inherent to the internal combustion engine 1 include variations in the condition of combustion in the engine per se (e.g., variations in the condition of combustion between the cylinders), detection errors of the crank-angle sensor 16 for detecting the crank angle, which serves as basic data for the calculation of angular velocities (e.g., errors of the sensor per se or mounting errors thereof), and errors of a CPU clock used in angular velocity calculation. Since these factors vary between individual internal combustion engine 1, each mean deviation MID of angular-velocity differences assumes a value which corresponds to the differences of the relevant internal combustion engine 1 from others, and which is substantially constant in spite of changes of the air-fuel ratio $\lambda$ within the first region so long as no misfire occurs. As shown in FIG. 3, such a mean deviation MD of angular-velocity differences at the stoichiometric air-fuel ratio $\lambda=1$ will be expressed as "$MD_{\pi=1}$".

As described above, as the air-fuel ratio 1 shifts toward the lean side, the mean deviation MD of angular-velocity differences increases. Increments at this time can be regarded as caused by increases in the risk of misfire. As shown in FIG. 3, such an increment of a mean deviation MD of angular-velocity differences will be expressed as "$\Delta MD$", and the mean deviation MD of angular-velocity differences including the misfire-risk increment $\Delta MD$, that is, a mean deviation MD of angular-velocity differences which corresponds to an air-fuel ratio $\lambda$ close to the misfire limit will be expressed as "$MD_L$".

During lean control, the air-fuel ratio $\lambda$ is maintained at, for example, $\lambda_X$, as shown in FIG. 3. In the embodiment being described, the fuel injection amount is feedback controlled on the basis of a misfire-risk increment $\Delta MD$ obtained by subtracting a mean deviation $MD_{\lambda=1}$ of angular-velocity differences which has been assumed within the region of the stoichiometric air-fuel ratio $\lambda=1$ from each mean deviation $MD_L$ of angular-velocity differences currently obtained. Thus, the mean deviation $MD_{\lambda=1}$ of angular-velocity differences at or in the vicinity of the stoichiometric air-fuel ratio $\lambda=1$ indicating the difference of the relevant internal combustion engine 1 is eliminated to allow only the misfire-risk increment $\Delta MD$ caused by an increase in the risk of the misfire to be used in the control of the air-fuel ratio. This enables a misfire limit to be determined correctly without being influenced by differences between individual internal combustion engines caused by factors such as those described above.

When effecting feedback control on the basis of differences in angular velocities in the internal combustion engine 1, the following control is performed, the specific details of which will be described below.

Figure 4:
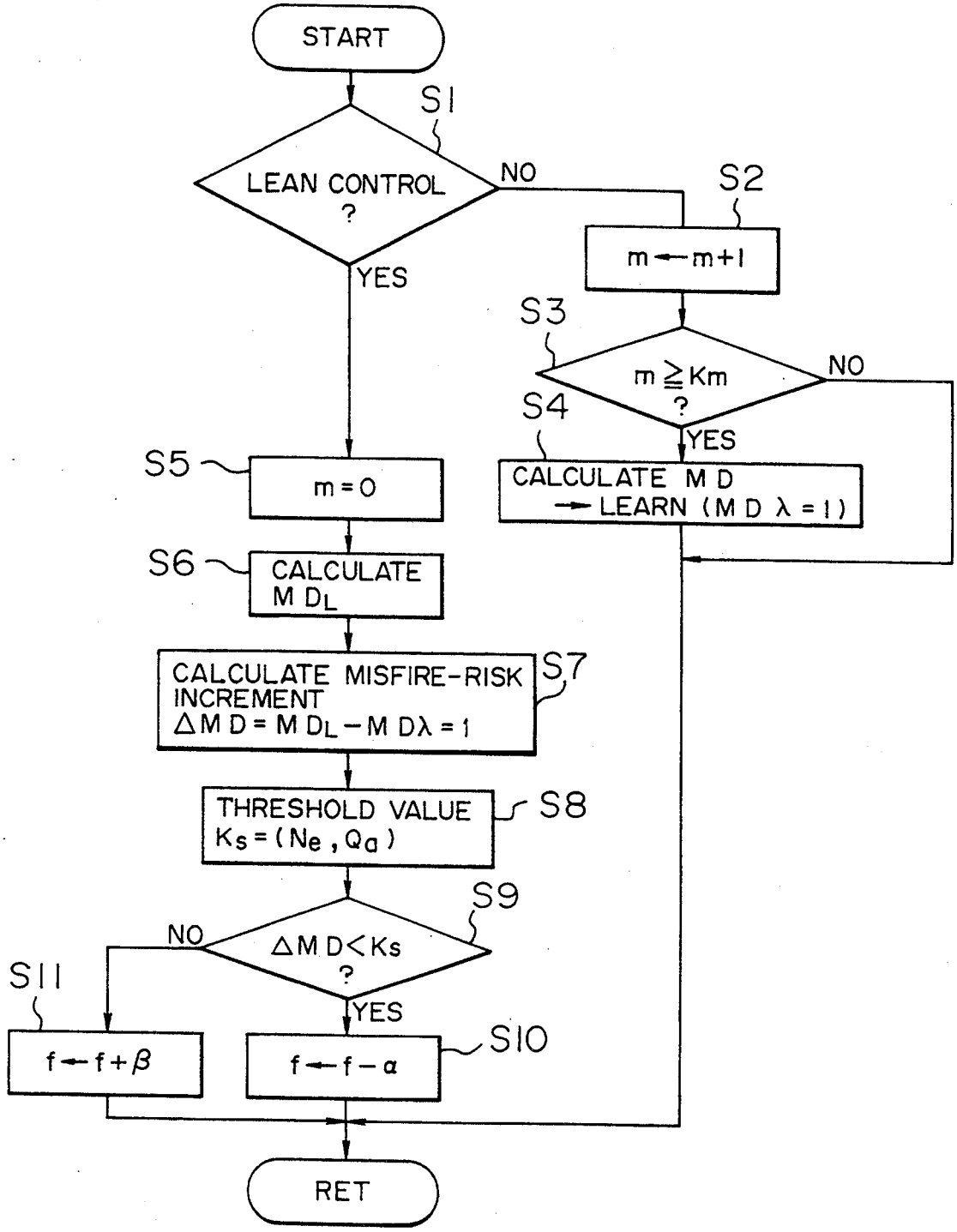
FIG. 4 is a flowchart showing air-fuel ratio processing performed by a CPU of the air-fuel ratio control apparatus according to the present invention.

FIG. 4 shows, in a flowchart, an air-fuel ratio control processing performed by the CPU 22 of the air-fuel ratio control apparatus according to the present invention.

The routine shown in FIG. 4 is executed each time a crank angle of 180° has been achieved in the internal combustion engine 1. In Step S1, the CPU 22 determines whether or not lean control is currently effected. If currently effected is normal air-fuel ratio control in which the target air-fuel ratio is the stoichiometric air-fuel ratio $\lambda=1$, Step S2 is executed. In Step S2, a counter value m indicating the time that has passed after the start of the normal air-fuel ratio control is incremented by 1 ($m \leftarrow m+1$). Then, in Step S3, it is determined whether or not the resultant counter value m is equal to or more than a predetermined counter value Km. If the counter value m is less than the predetermined counter value Km ($m<Km$), it is estimated that the actual air-fuel ratio has not been controlled to or to the vicinity of the stoichiometric air-fuel ratio $\lambda=1$. In this case, the current execution of the routine is terminated. If it is determined, in Step S3, the counter value m is above the predetermined counter value Km ($m \geqq Km$), it is estimated that the actual air-fuel ratio has been controlled to or to the vicinity of the stoichiometric air-fuel ratio in the process in which the normal air-fuel ratio control has been continued. In this case, a mean deviation MD is calculated as the mean value of differences between angular velocities $\Delta\omega$, in Step S4.

The mean deviation MD is calculated in the following manner: on the basis of a pulse signal from the crank-angle sensor 16, an angular velocity at a predetermined crank angle past a point corresponding to ignition in one of the cylinders is calculated; and the thus obtained angular velocity is subtracted from the angular velocity with regard to another of the cylinders in which ignition has occurred immediately prior to the relevant cylinder, thereby obtaining a difference between angular velocities $\Delta\omega$. Thus, an angular-velocity difference $\Delta\omega$ indicates the difference between angular velocities with regard to two cylinders in which ignition has occurred subsequently. When ignition has sequentially occurred in all of the four cylinders (i.e., when a crank angle of 720° has been achieved), the mean value x of four angular-velocity differences $\Delta\omega$ is calculated by the following formula:

$$x = \frac{1}{4} \sum_{i=0}^{3} (\Delta\omega i)$$

Subsequently, on the basis of the angular-velocity differences $\Delta\omega$ and the thus obtained mean value x thereof, the mean deviation MD of the angular-velocity differences $\Delta\omega$ is calculated by the following formula:

$$MD = \sum_{i=0}^{3} |x - \Delta\omega i|$$

The thus calculated MD is stored, in the RAM 24, as a mean deviation $MD_{\lambda=1}$ of angular-velocity differences $\Delta\omega$ during the stoichiometric air-fuel ratio $\lambda=1$. Then, the current execution of the routine is terminated.

Thus, during normal air-fuel ratio control, when the actual air-fuel ratio is estimated to have been controlled to or to the vicinity of the stoichiometric air-fuel ratio $\lambda=1$, the procedures of Step S4 is repeatedly executed, so that the latest mean deviation MD of angular-velocity differences $\Delta\omega$ can be learned.

On the other hand, if it is determined, in Step S1, that lean control is being effected, Step S5 is executed, in which the counter value m is reset. Accordingly, when normal air-fuel ratio control is again effected after lean control has been effected, the execution of the procedure of Step S4 is prohibited until the counter value is above the predetermined value Km. Subsequently, the CPU 22 executes Step S6, in which a mean deviation $MD_L$ of angular-velocity differences $\Delta\omega$ during the lean control is calculated in a manner similar to that in Step S4. Then, in Step S7, a misfire-risk increment $\Delta MD$ is calculated by the following formula:

$$\Delta MD = MD_L - MD_{\lambda=1}$$

Subsequently, in Step S8, a threshold value $K_S$ corresponding to the region in which the internal combustion engine 1 is operating is determined in accordance with the map (not shown) stored in the ROM 23 and on the basis of an engine rotational speed Ne calculated from a pulse signal from the crank-angle sensor 16 and an intake air amount Qa detected by the air flow meter 6. Then, in Step S9, it is determined whether or not the misfire-risk increment $\Delta MD$ is less than the threshold value $K_S$. If the answer to this question is affirmative ($\Delta MD < K_S$), it is estimated that the condition of combustion in the engine is still in a normal region, and that the air-fuel ratio can be corrected to a value for producing a leaner mixture. This is followed by the execution of Step S10. In Step S10, a first prescribed value $\alpha$ is subtracted from an air-fuel ratio correction coefficient f ($<1.0$) by which the fuel injection amount is to be multiplied, thereby reducing the fuel injection amount to correct the actual air-fuel ratio to a value on the lean side. Then, the current execution of the routine is terminated.

If the misfire-risk increment $\Delta MD$ is above the threshold value $K_S$ ($\Delta MD \geqq K_S$), it is estimated that a misfire limit has been reached, and that the air-fuel ratio must be corrected to the rich side. Then, Step S11 is executed, in which a second prescribed value $\beta$ is added the air-fuel ratio correction coefficient f by which the fuel injection amount is to be multiplied, thereby increasing the fuel injection amount to correct the actual air-fuel ratio to the rich side. Then, the current execution of the routine is terminated.

Thus, in lean control, the fuel injection amount is feedback controlled in accordance with a misfire-risk increment $\Delta MD$ in such a manner as to maintain the actual air-fuel ratio in the vicinity of a misfire limit.

As will be understood from the above description, the present invention provides, for an internal combustion engine 1 serving as an internal combustion engine M1, a crank-angle sensor 16, a CPU 22 executing the procedure of Step S4 and the CPU 22 executing the procedure of Steps S6 to S11, which respectively function as a variation detecting means M2, a variation learning means M3, and a lean air-fuel ratio correcting means M4.

Thus, the air-fuel ratio control apparatus for an internal combustion engine according to this embodiment of the present invention includes the crank-angle sensor 16 for outputting a pulse signal in synchronization with the rotation of the crankshaft of the internal combustion engine 1, and the CPU 22. During normal air-fuel ratio control in which the target air-fuel ratio is the stoichiometric air-fuel ratio $\lambda=1$, the CPU 22 is adapted to learn a mean deviation $MD_{\lambda=1}$ of angular-velocity differences $\Delta\omega$ on the basis of a pulse signal from the crank-angle sensor 16. During lean control in which the air-fuel ratio in the internal combustion engine 1 is maintained in the vicinity of a misfire limit, the CPU 22 is adapted to subtract the mean deviation $MD_{\lambda=1}$ of angular-velocity differences $\Delta\omega$ during the adoption of the stoichiometric air-fuel ratio $\lambda=1$ from the current mean deviation $MD_L$ of angular-velocity differences $\Delta\omega$ calculated from a pulse signal form the crank-angle sensor, thereby calculating a misfire-risk increment $\Delta MD$, and to correct the fuel injection amount on the basis of the misfire-risk increment $\Delta MD$.

Therefore, during lean control, the mean deviation component $MD_{\lambda=1}$ which can be caused by differences in the internal combustion engine 1 during the adoption of the stoichiometric air-fuel ratio $\lambda=1$ is eliminated, and only the misfire-risk increment $\Delta MD$ attributable to an increase in the risk of misfire is used to control the air-fuel ratio. Accordingly, it is possible to correctly determine a misfire limit without involving influences by differences of the internal combustion engine 1, so as to realize highly precise lean control, which in turn makes it possible to prevent drivability from being impaired by misfire, and to sufficiently provide advantages of lean control, that is, reduced fuel consumption and emission.

Although in the above-described embodiment, the air-fuel ratio is controlled, in lean control, by subtracting the mean deviation $MD_{\lambda=1}$ corresponding to the stoichiometric air-fuel ratio $\lambda=1$ from the mean deviation $MD_L$ during the lean control, thereby obtaining a misfire-risk increment $\Delta MD$ attributable to an increase in the risk of misfire, and comparing the misfire-risk increment $\Delta MD$ with a threshold value $K_S$, the present invention may be embodied in another form so long as the influence of difference of the relevant internal combustion engine can be eliminated. For example, the mean deviation $MD_{\lambda=1}$ corresponding to the stoichiometric air-fuel ratio $\lambda=1$ may be added to the threshold value $K_S$, and the resultant sum may be compared with the mean deviation $MD_L$ during the lean control.

Further, although in the above-described embodiment, the latest mean deviation MD is learned during normal air-fuel ratio control in which the stoichiometric air-fuel ratio $\lambda=1$ is used as the target air-fuel ratio, the present invention may be embodied in another form, and the latest mean deviation MD may be learned during the adoption of an air-fuel ratio other than the above so long as the adopted air-fuel ratio has substantially no risk of misfire occurring in the relevant internal combustion engine. For example, such a mean deviation MD may be learned when a fuel-cut operation is performed for deceleration, etc., of the vehicle. In this case, since the mean deviation MD is learned in the condition in which the internal combustion engine does not perform its cycles, it is not possible to eliminate influence by the condition of combustion in the engine. However, it is possible to eliminate influences by other factors such as detection errors of a crank-angle sensor or errors of a CPU clock.

Further, although in the foregoing embodiment, a misfire limit of the relevant internal combustion engine is determined on the basis of certain rotational variations (mean deviations MD of angular-velocity differences $\Delta\omega$ of the engine rotational speed Ne), the present invention may be embodied in another form, and another type of variations may be used so long as the variations are generated in synchronization with the rotation of the internal combustion engine and increase as the risk of misfire increases. For example, it is possible to determine a misfire limit on the basis of variations of the output torque of the internal combustion engine, or those of the internal pressure of the cylinders.

As has been described above, according to an air-fuel ratio control apparatus for an internal combustion engine according to the present invention, the air-fuel ratio for the internal combustion engine is controlled during lean control on the basis of the current variation and a variation during the adoption of an air-fuel ratio having substantially no risk of misfire, thereby making it possible to eliminate the variation component that varies between individual internal combustion engine, and to use only the variation component that is attributable to an increased risk of misfire for the correction of the air-fuel ratio. Accordingly, it is possible to correctly detect a misfire limit without involving influence by differences between individual internal combustion engine, and thus to realize highly precise lean control. As a result, it is possible to prevent drivability form being impaired by misfire, and to allow lean control to provide sufficient advantages of reductions in fuel consumption and emission.

What is claimed is:

1. An air-fuel ratio control apparatus for an internal combustion engine for controlling the air-fuel ratio for said internal combustion in accordance with the operating region of said internal combustion engine within a range of the air-fuel ratio from a value having substantially no risk of misfire to a value on the lean side of the stoichiometric air-fuel ratio and close to a misfire limit, said apparatus comprising:

variation detecting means for detecting variations periodically generated in synchronization with the rotation of said internal combustion engine;

variation learning means for learning the latest one of variations detected by said variation detecting means when the air-fuel ratio for said internal combustion engine is controlled at a value having substantially no risk of misfire; and lean air-fuel ratio correcting means for correcting the air-fuel ratio for said internal combustion engine on the basis of the current variation detected by said variation detecting means and the variation which has been learned by said variation learning means when the air-fuel ratio for said internal combustion engine is controlled at a value close to said misfire limit.

2. An air-fuel ratio control apparatus according to claim 1, wherein said lean air-fuel ratio correcting means calculates the difference between said current variation and said variation which has been learned, and wherein the air-fuel ratio is controlled to a value on the rich side when said difference is above a predetermined value and to a value on the lean side when said difference is below said predetermined value.

3. An air-fuel ratio control apparatus according to claim 2, wherein a plurality of predetermined values are set beforehand in correspondence with amount of intake air and number of revolutions per unit time of said engine.

4. An air-fuel ratio control apparatus according to claim 1, wherein said variation detecting means calculates an angular velocity each time ignition occurs in said internal combustion engine, calculates the difference between the currently calculated angular velocity and the previously calculated angular velocity, and calculates a mean angular-velocity difference from a plurality of such angular-velocity differences which have been calculated, said mean angular-velocity difference being calculated as a variation detected.

* * * * *